United States Patent [19]

Martin

[11] Patent Number: 4,892,232

[45] Date of Patent: Jan. 9, 1990

[54] UNIT DOSE DISPENSER

[76] Inventor: James H. Martin, 8322 County Line Rd., Burr Ridge, Ill. 60521

[21] Appl. No.: 225,081

[22] Filed: Jul. 25, 1988

[51] Int. Cl.[4] ..... B65D 37/00

[52] U.S. Cl. ..... 222/207; 222/212; 222/321; 222/386.5; 222/402.2

[58] Field of Search ..... 222/95, 105, 183, 207, 222/212, 214, 321, 336, 340, 341, 380, 383, 385, 386.5, 402.1, 402.2

[56] References Cited

U.S. PATENT DOCUMENTS

| | | | |
|---|---|---|---|
| 3,001,524 | 9/1961 | Maison et al. . | |
| 3,092,107 | 6/1963 | Froot | 222/386.5 X |
| 3,104,785 | 9/1963 | Beard, Jr. | 222/207 |
| 3,161,329 | 12/1964 | Fedit et al. | 222/321 |
| 3,452,905 | 7/1969 | Micallef | 222/207 |
| 4,057,176 | 11/1977 | Horvath | 222/321 X |
| 4,061,247 | 12/1977 | Meshberg | 222/321 X |
| 4,088,425 | 5/1978 | Bennett | 222/321 X |
| 4,138,039 | 2/1979 | Micallef | 222/321 |
| 4,220,264 | 9/1980 | Gamadia | 222/207 |
| 4,387,833 | 6/1983 | Venus, Jr. | 222/95 |
| 4,458,830 | 7/1984 | Werding | 222/212 X |

FOREIGN PATENT DOCUMENTS

| | | | |
|---|---|---|---|
| 133770 | 3/1985 | European Pat. Off. | 222/402.1 |
| 1299724 | 6/1962 | France | 222/402.2 |

*Primary Examiner*—Kevin P. Shaver

*Attorney, Agent, or Firm*—Edmond T. Patnaude

[57] ABSTRACT

A unit dose liquid dispenser includes a resilient metering reservoir disposed within a main reservoir in which a large supply of the liquid is maintained under pressure. Depression of an actuator to a dispensing position connects the metering chamber to the ambient while sealing it from the main reservoir resulting in the collapse of the metering reservoir and expulsion of the contents to the atmosphere at the pressure in the main reservoir.

4 Claims, 3 Drawing Sheets

UNIT DOSE DISPENSER

The present invention relates in general to a device for dispensing a premeasured dose of liquid from a reservoir containing a larger supply of the liquid, and it relates in particular to a new and improved dispenser in which the liquid supply is maintained under pressure and the premeasured dose is dispensed at a predetermined pressure.

BACKGROUND OF THE INVENTION

Finger operated pumps for dispensing small amounts of liquid from a container are well known. See, for example, U.S. Pat Nos. 3,001,524 and 3,452,905. Such pumps are relatively complex and do not dispense a predetermined amount of liquid because the amount of liquid dispensed upon each actuation of the pump depends on the way in which the pump is actuated, i.e., the speed and stroke of the actuator affect the quantity of the liquid dispensed.

Particularly where medicaments are to be dispensed, it would be desirable to provide a mechanism which dispenses a predetermined quantity of liquid every time the dispenser is actuated irrespective of the force applied to the actuator.

SUMMARY OF THE INVENTION

Briefly, there is provided in accordance with the teachings of the present invention a new and improved unit dose liquid dispenser in which a supply of liquid is held under pressure in an elastomeric main reservoir, and a premeasured dose of the liquid is dispensed at the pressure of the liquid in the main reservoir upon each actuation of an actuator. In a preferred embodiment a second resilient and collapsible metering reservoir is located within the main elastomeric reservoir and is collapsed by the pressure within the main reservoir when the actuator connects the metering chamber in the collapsible metering reservoir to the ambient thereby dispensing the entire contents of the metering chamber at a predetermined pressure.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT

Figure 1:
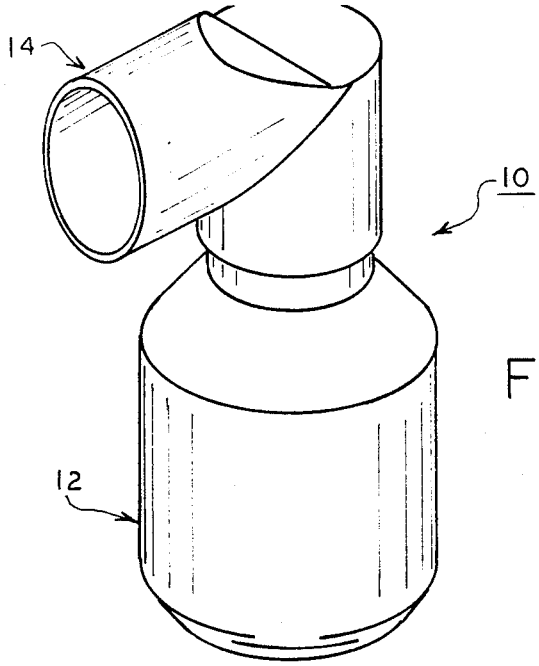
FIG. 1 is a perspective view of a unit dose dispenser embodying the present invention.

Referring particularly to FIG. 1, a unit dose liquid dispenser 10 includes a generally cylindrical container 12 to the top of which is mounted a combined spray head and actuator 14. Depression of the head 14 causes the dispensing of a premeasured quantity of liquid in spray form at a predetermined pressure.

Figure 2:
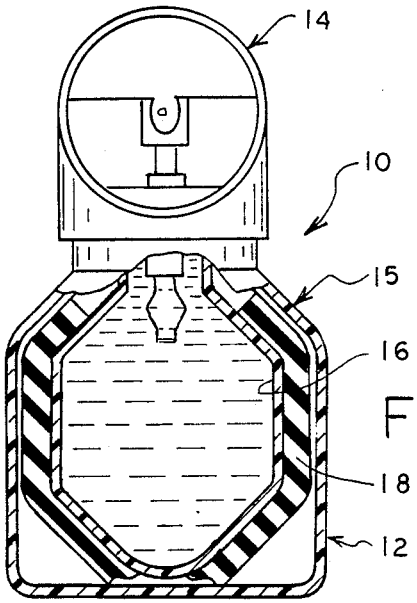
FIG. 2 is a partially sectioned, elevational view of the dispenser of FIG. 1.
Figure 3:
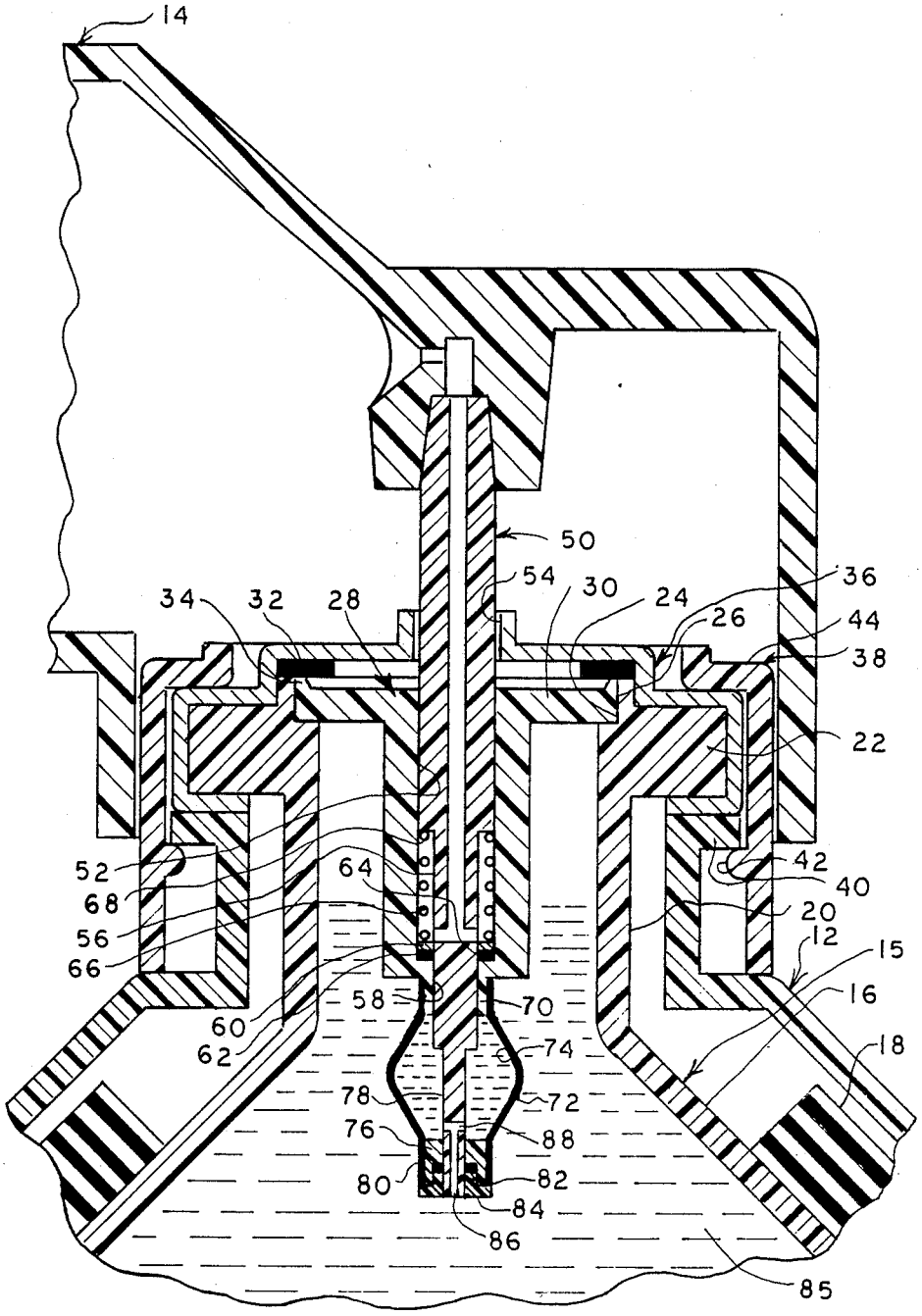
FIG. 3 is an enlarged, vertically sectioned view of the operating parts of the dispenser shown in FIG. 1, the dispenser being shown in the standby condition with the metering chamber filled with a liquid to be dispensed.
Figure 4:
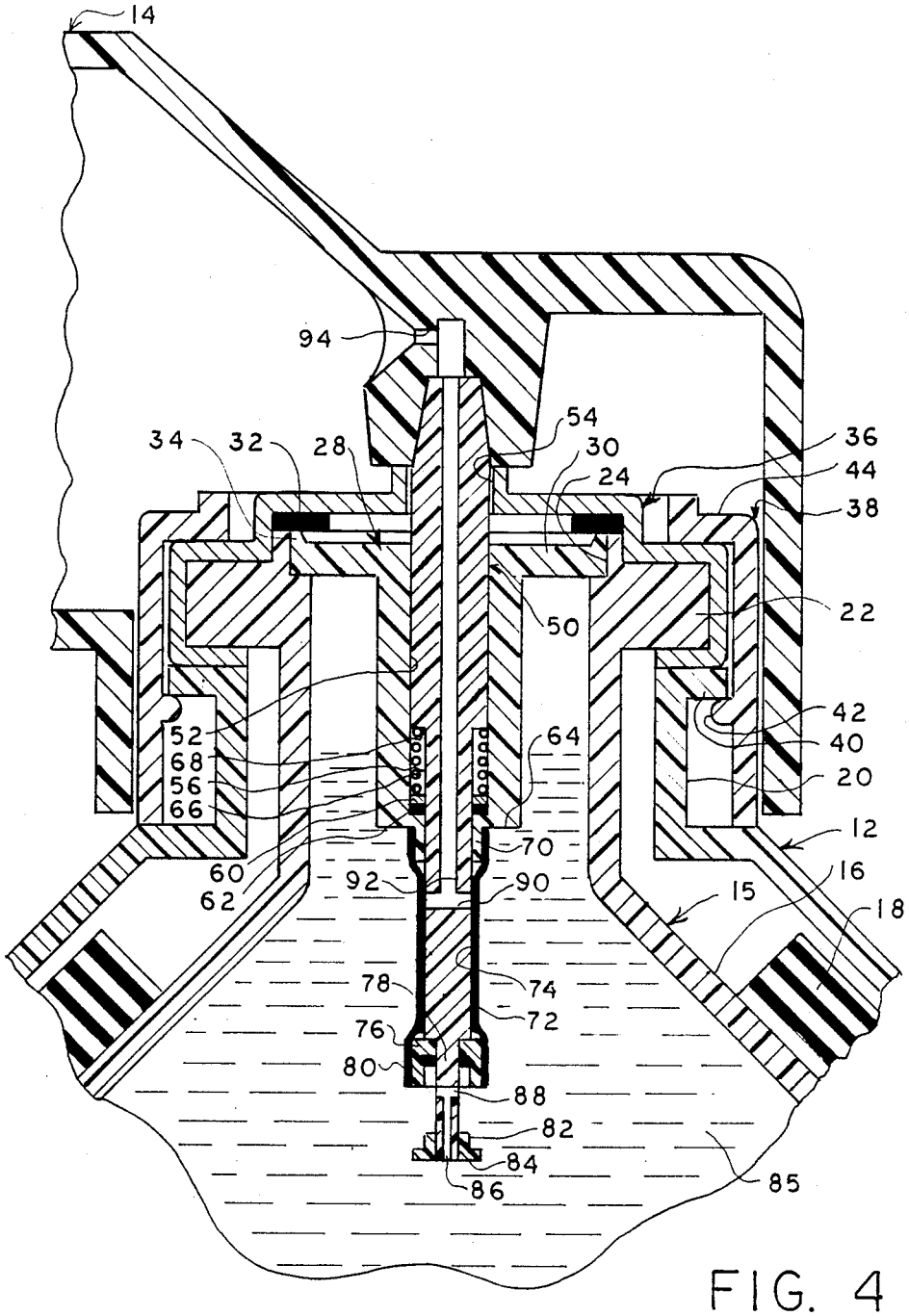
FIG. 4 is a view similar to that of FIG. 3 but showing the dispenser at the completion of a dispensing operation.

Referring now to FIGS. 2, 3 and 4, it may be seen that the container 12 houses a main reservoir 15 which includes an expandable and collapsible inner container 16 which is enclosed by an elastomeric sleeve 18. The sleeve 18 is shown in the expanded condition wherein it exerts a substantially constant compressive force on the contents of the container 16. A pressurized reservoir of this type is described in greater detail in U.S. Pat. No. 4,387,833.

As best shown in FIG. 3 the container 16, which is preferably blow molded, is formed of plastic and includes a tubular neck section 20 having an external annular flange 22 near the top. A counterbore 24 is provided at the top of the neck section 20 which is defined by a raised annular bead 26. A generally tubular valve housing member 28 has an external annular flange 30 at the top which seats in the counterbore 24. An annular gasket 32 is positioned over the top of the bead 26, and a raised lip 34 disposed at the outer edge of the flange 30 on a locking ring 36 formed of metal compresses the gasket 32 against the top surfaces of the bead 26 and the lip 34 and holds the housing in assembled relationship to the neck of the container 16.

A locking cap 38 is snap fitted over the locking ring 36 and the upstanding neck portion of the outer housing 12. As shown, an external annular flange 40 at the top of the container 12 seats against the bottom of the ring 36, and an internal annular bead 42 on the cap 38 extends under the flange 40 while an internal annular flange portion 44 at the top seats against the top of the ring 36.

A valve stem 50 is slidably fitted in an axial bore 52 in the tubular housing member 28 and extends upwardly through a central opening 54 in the ring 36. The stem 50 has a reduced diameter section 56 which extends downwardly through a narrow bore 58 at the bottom of the housing 28. A flat washer 60 is slidably fitted over the reduced diameter section 56 over an annular gasket 62 which rests on an annular shoulder 64 on the housing 28. A coil spring 66 surrounds the stem 50 and is positioned between the washer 60 and a downwardly facing annular shoulder 68 at the junction of the large and small diameter sections of the stem 50 to urge the stem in an upward direction to the standby position shown in FIG. 3.

Fixedly secured over the tubular lower end portion 70 of the housing member 28 is an elastomeric, generally tubular reservoir member 72 which is shown in FIG. 3 in its relieved, unstressed condition. In its unstressed condition the elastomeric member 72 encloses a somewhat spherical metering chamber 74 through which the lower end portion of the stem 50 slidably and sealably extends. As may be seen in FIG. 3, the lower tubular end of the reservoir member 72 is sealably bonded to a tubular sleeve 76 through which the thin, cylindrical lower end section 78 of the stem 50 slidably extends. An O-ring type sealing ring 80 is tightly fitted in a counterbore 82 and a cap 84 is bonded to the lower end of the stem 50. The cap has an upwardly extending tubular section which slidably fits into the counterbore 82 to hold the sealing ring 80 in compression when the stem 50 is in the up position as shown in FIG. 3.

In order to permit some of the liquid 85 which fills the container 16 to fill the unit dose metering chamber 74 when the stem 50 is in the standby position shown in FIG. 3, the stem 50 is provided with an axial passageway 86 which extends from the bottom end thereof to a location where it opens onto a transverse passageway 88 which itself opens into the chamber 74 when the stem 50 is in its upward position. Because of the memory of the elastomeric reservoir member 72 and the fact that there is no pressure differential across it, when the stem 50 is in the upward standby position shown in FIG. 3, the member 72 returns to its unstressed state and liquid 85 flows into the metering chamber to fill it with a predetermined dose of liquid.

When the spray head actuator 14 is depressed, the stem 50 is moved downwardly to the position shown in FIG. 4 wherein the unit dose metering chamber 74 is communicated to the ambient by interconnected passageways 90 and 92 in the stem 50. The passageway 90 extends transversely through the stem 50 and the passageway 92 extends axially from the passageway 90 to the upper end of the stem 50 where it connects to a dispensing orifice 94 in the spray head 14. As the stem 50 is moved down, the passageway 72 moves out of the chamber 74 to seal the metering chamber 74 from the main reservoir chamber while the passageway 90 moves into the metering chamber 74 to communicate it to the ambient. With the metering chamber 74 open to the ambient via the passageways 90 and 92 and the orifice 94, the pressure in the main reservoir collapses the reservoir 72 to force the entire contents of the metering chamber 74 into the ambient at the pressure in the main reservoir.

The reservoir 15 maintains its contents at a substantially constant pressure as the contents are dispensed. Initially, the pressure is at a maximum, drops off to about 85 percent of the initial pressure after about 10 percent of the contents have been dispensed, and remains at that second pressure until about 90 percent of the contents have been dispensed. The pressure then drops off as the last 10 percent of the contents are dispensed.

The dispenser of the present invention has many different applications and may, for example, be used with a nebulizer orifice for spraying predetermined quantities of a liquid directly into the nasal passages of a patient at a substantially predetermined pressure.

While the present invention has been described in connection with a particular embodiment thereof, it will be understood by those skilled in the art that many changes may be made without departing from the true spirit and scope of the present invention. Therefore, it is intended by the appended claims to cover all such changes and modifications which come within the true spirit and scope of this invention.

What is claimed is:

1. Dispensing apparatus for dispensing a predetermined quantity of fluid, comprising in combination first elastomeric reservoir means for containing a supply of said fluid under pressure, second elastomeric reservoir means disposed within said first reservoir means, manually operable fluid dispensing means for communicating said first reservoir to said second reservoir when in a first position to permit fluid from said first reservoir to flow into said second reservoir; and when in a second position for sealing said reservoirs from one another and communicating said second reservoir to a location which is exterior of both said reservoirs to permit fluid in said second reservoir to escape therefrom at said pressure, and said manually operable fluid dispensing means includes means responsive to the movement of said dispensing means from said first position to said second position for applying a mechanical force to compress said second reservoir.

2. Dispensing apparatus, comprising in combination a first reservoir for containing a quantity of fluid under pressure, said reservoir having an opening therein, manually operable means mounted in said reservoir across said opening for dispensing a predetermined amount of fluid in response to each actuation thereof, said manually operable means including a second elastomeric generally tubular metering reservoir having an expanded, unstressed position defining a metering chamber therein, an elongate valve stem extending coaxially through said second reservoir and movable between a first position and a second position, said valve stem having a first axial orifice extending from one end located exteriorly of said first and second reservoirs to a location remote from the other end, said orifice being sealed from said second reservoir when said valve stem is in said first position and opening into said second reservoir when said valve stem is in said second position, and said valve stem having a second axial orifice extending from said other end, said other end being in communication with said first reservoir, said second orifice opening into said second reservoir when said valve stem is in said first position and being sealed from said second reservoir when said valve stem is in said second position, whereby said second reservoir is in communication with said first reservoir when the valve stem is in said first position to permit said fluid to flow into said second reservoir from said first reservoir and fluid flows out of said second reservoir when said valve stem is in said second position.

3. Dispensing apparatus, comprising in combination a first elastomeric reservoir for containing a quantity of fluid under pressure, said reservoir having an opening therein, manually operable means mounted in said reservoir across said opening for dispensing a predetermined amount of fluid in response to each actuation thereof, said manually operable means including a second elastomeric generally tubular metering reservoir having an expanded, unstressed position defining a metering chamber therein, an elongated valve stem extending coaxially through said second reservoir and movable between a first position and a second position, said valve stem having a first axial orifice extending from one end located exteriorly of said first and second reservoirs to a location remote from the other end, said orifice being sealed from said second chamber when said valve stem is in said first position and opening into said second chamber when said valve stem is in said second position, and said valve stem having a second axial orifice extending from said other end, said other end being in communication with said first reservoir, said second orifice opening into said second reservoir when said valve stem is in said first position and being sealed from said second chamber when said valve stem is in said second position, whereby said second reservoir is in communication with said first reservoir when valve stem is in said first position to permit said fluid to flow into said second reservoir from said first reservoir and fluid flows out of said second reservoir when said valve stem is in said second position.

4. Dispensing apparatus for dispensing a predetermined quantity of fluid, comprising in combination a first reservoir for containing a supply of said fluid under pressure, manually operated means for dispensing said predetermined quantity of fluid in response to each actuation thereof, said manually operated means including a second elastomeric metering reservoir disposed within said first reservoir, and valve means movable between a first position and a second dispensing position, said valve means communicating said second elastomeric reservoir to said first reservoir and sealing said elastomeric reservoir from the atmosphere when said valve means is in said first position, and communicating said elastomeric reservoir to a location to which said predetermined quantity of fluid is to be dispensed and sealing said elastomeric reservoir from said first reservoir when said valve means is in said second position, means for expanding said second elastomeric reservoir when said valve means is in said first position, spring means for biasing said valve means into said first position, and said valve means including:

a valve stem moveable between said first position and said second position, said second elastomeric reservoir includes a tubular elastomeric sleeve, said valve stem extends coaxially through said elastomeric sleeve, and an axial passageway extending from one end of said valve stem located externally of said first and second reservoirs and communicating with said second reservoir when said valve stem is in said second position and being sealed from said second reservoir when said valve stem is in said first position.

* * * * *